US010494846B2

(12) United States Patent
Schmid

(10) Patent No.: US 10,494,846 B2
(45) Date of Patent: Dec. 3, 2019

(54) ACTUATOR FOR FURNITURE PARTS

(71) Applicant: Julius Blum GmbH, Hoechst (AT)

(72) Inventor: Malte Schmid, Bodolz (DE)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/209,123

(22) Filed: Dec. 4, 2018

(65) Prior Publication Data

US 2019/0106918 A1 Apr. 11, 2019

Related U.S. Application Data

(63) Continuation of application No. PCT/AT2017/060094, filed on Apr. 13, 2017.

(30) Foreign Application Priority Data

Jun. 22, 2016 (AU) ..... 50564/2016

(51) Int. Cl.
*E05D 7/12* (2006.01)
*E05D 11/10* (2006.01)
(Continued)

(52) U.S. Cl.
CPC ..... *E05D 7/125* (2013.01); *E05D 11/1007* (2013.01); *E05D 15/401* (2013.01);
(Continued)

(58) Field of Classification Search
CPC ..... E05D 7/125; E05D 3/16; E05D 2003/163; E05D 11/1007; E05D 15/40;
(Continued)

(56) References Cited

U.S. PATENT DOCUMENTS 7,966,699 B2 6/2011 Dubach et al.
8,056,991 B2 * 11/2011 Hollenstein ..... A47B 51/00 312/312
(Continued)

FOREIGN PATENT DOCUMENTS

WO 2007/041736 4/2007
WO 2011/011800 2/2011
WO 2015/027253 3/2015

OTHER PUBLICATIONS

International Search Report dated Jun. 29, 2017 in International (PCT) Application No. PCT/AT2017/060094.
(Continued)

*Primary Examiner* — Daniel J Rohrhoff
(74) *Attorney, Agent, or Firm* — Wenderoth, Lind & Ponack, L.L.P.

(57) ABSTRACT

An actuating drive for moving a furniture part movably supported relative to a furniture carcass, includes at least one pivotally mounted actuating arm for moving the movable furniture part, a spring device for applying a force to the actuating arm, and a locking device for releasably locking the actuating arm. The locking device includes at least one movably-mounted locking element cooperating with at least one locking recess in a position in which the actuating arm is locked. The locking element can be unlocked from the at least one locking recess by a switch element to be operated manually, and can also be unlocked by a control portion arranged on the actuating arm. The control portion can be acted upon by mounting the movable furniture part to the actuating arm.

16 Claims, 8 Drawing Sheets

(51) Int. Cl.
*E05F 1/10* (2006.01)
*E05D 15/40* (2006.01)
*E05D 15/46* (2006.01)

(52) U.S. Cl.
CPC ..... *E05F 1/1058* (2013.01); *E05D 15/463* (2013.01); *E05Y 2201/624* (2013.01); *E05Y 2900/20* (2013.01)

(58) Field of Classification Search
CPC ..... E05D 15/401; E05D 15/463; E05F 1/058; E05F 1/1261; E05Y 2900/20
See application file for complete search history.

(56) References Cited

U.S. PATENT DOCUMENTS 8,303,055 B2 * 11/2012 Scheffknecht ..... E05D 15/262 312/319.6
8,468,653 B2 * 6/2013 Tumler ..... E05D 11/10 16/286
9,909,346 B2 * 3/2018 Holzapfel ..... E05D 15/401
10,246,915 B2 * 4/2019 Brunnmayr ..... E05D 3/14
10,253,539 B2 * 4/2019 Kaiser ..... E05F 1/1075
2007/0209157 A1 * 9/2007 Kung ..... E05D 15/262 16/240
2008/0209682 A1 * 9/2008 Dubach ..... E05D 3/14 16/319
2011/0138960 A1 * 6/2011 Omann ..... E05C 19/165 74/490.07
2012/0000130 A1 * 1/2012 Kashiwaguma ..... E05F 1/1058 49/348
2012/0079684 A1 4/2012 Tumler
2012/0161598 A1 * 6/2012 Blum ..... E05F 1/1276 312/319.2
2013/0333291 A1 * 12/2013 Blum ..... E05F 1/1058 49/386
2014/0317883 A1 * 10/2014 Baldreich ..... E05F 1/1058 16/280
2016/0168896 A1 6/2016 Holzapfel

OTHER PUBLICATIONS

Search Report dated Jan. 1, 2017 in Austrian Application No. A 50564/2016, with English translation.

* cited by examiner

ACTUATOR FOR FURNITURE PARTS

BACKGROUND OF THE INVENTION

The present invention relates to an actuating drive for moving a furniture part movably supported relative to a furniture carcass. The actuating drive includes at least one pivotally mounted actuating arm for moving the movable furniture part, a spring device for applying a force to the actuating arm, and a locking device for releasably locking the actuating arm. The locking device includes at least one movably-mounted locking element cooperating with at least one locking recess in a position in which the actuating arm is locked.

Actuating drives with a locking device for locking a pivotal position of the actuating arm are, in particular, used for moving furniture flaps which are movable in a height direction relative to a furniture carcass. By the provision of the spring device, the weight of the furniture flap can be at least partially compensated, so that the movement of the furniture flap is assisted by the spring device and thus the actuation for an operator can be facilitated. Critical situations may arise when the furniture flap is not yet connected to the actuating arm. In such a case, no counterweight is applied to the spring device, so that the flap-less actuating arm, due to the force of the pressurizing spring device, can kick out in an uncontrolled manner and, as a result, can cause serious injuries to the mounting personnel or damages to objects.

Actuating drives with a locking device for releasably locking a pivotal position of the actuating arm are shown, for example, in WO 2007/041736 A1 and WO 2011/011800 A2.

SUMMARY OF THE INVENTION

It is an object of the present invention to propose an actuating drive mentioned in the introductory part, having a more comfortable possibility of unlocking.

According to the invention, the locking element can be unlocked from the at least one locking recess by a directly accessible switch element (i.e., a switch element that can be directly accessed by a user during operation without disassembly) to be actuated manually, and also by a control portion arranged on the actuating arm, in which the control portion can be acted upon by mounting the movable furniture part to the actuating arm.

In other words, a locking device with a movably-mounted locking element is provided, the locking element being configured to be unlocked from a position in which the actuating arm is locked, both by a manual actuation of a switch element and also by mounting the movable furniture part to the actuating arm. For the assembling person on the spot, there is an advantage in that the actuating arm can be arbitrarily released from the locking position by a manual actuation or also by mounting the furniture flap to the actuating arm, and each of the switch element and the control portion cooperate with the same locking element. The switch element and the control portion are movement-coupled to one another, preferably by the locking element, so that upon a movement of the switch element, the control portion, and, upon a movement of the control portion, also the switch element moves therewith.

The switch element can be movably mounted between a first switching position and a second switching position. In the first switching position, the locking element is locked with the at least one locking recess. In the second switching position, the locking element can be unlocked from the locking recess. The switch element is configured for manual actuation or can include an adaptor for receiving a tool, and the locking between the locking element and the at least one locking recess can be released by applying a force to the switch element.

When the application of force by the user to the switch element is removed or the connection between the movable furniture part and the actuating arm is released, the locking element is immediately moved into the locking position by a force of a spring element, so that the actuating arm is locked in its pivotal position and, as result, cannot kick out further in a direction of the open position.

According to an embodiment, the actuating arm can be locked in a closed position by a cooperation between the locking element and the at least one locking recess. In this way, the movable furniture part can be connected to the actuating arm located in the closed position. However, at least one second locking recess can be provided, and the actuating arm can be locked in an open position by a cooperation of the locking element with the second locking recess. If appropriate, a third locking recess can be provided, and the actuating arm can be locked by a cooperation of the locking element with the third locking recess in an intermediate position lying between the open position and the closed position, and preferably the intermediate position corresponds to the half-open position of the actuating arm.

Overall, this results in at least three different locking positions of the actuating arm (namely the closed position, the open position and the half-open position of the actuating arm), so that the actuating arm can be connected to the furniture flap in these three different predetermined pivoting positions.

BRIEF DESCRIPTION OF THE DRAWINGS

Further details and advantages of present invention result from the embodiment shown in the drawings, in which.

DETAILED DESCRIPTION OF THE INVENTION

Figure 1A:
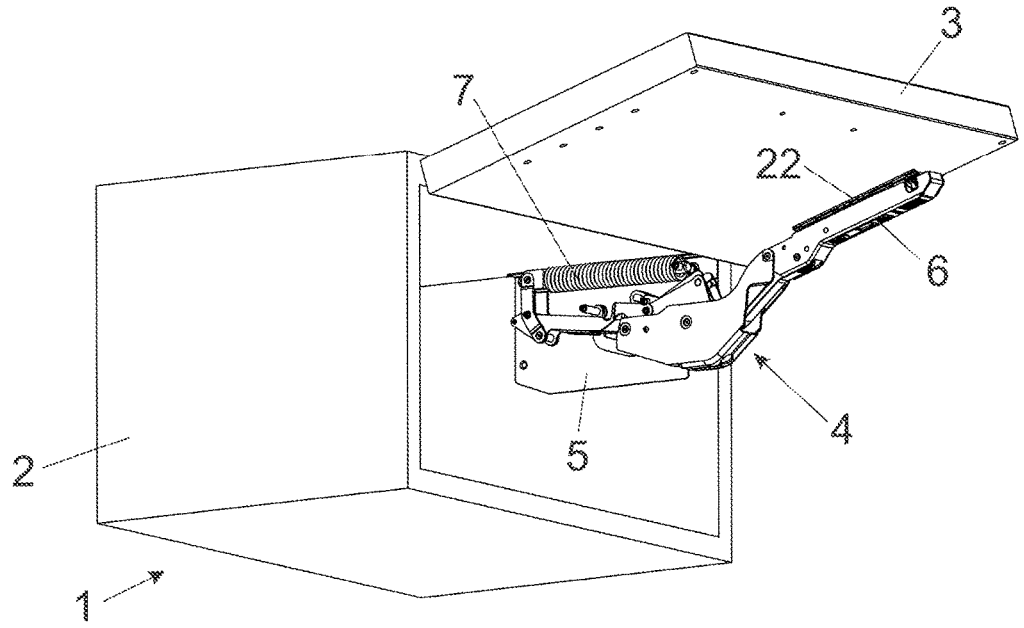
FIG. 1*a*, 1*b* show an item of furniture having a furniture carcass and a furniture part movably supported relative to the furniture carcass, and an actuating drive for moving the movable furniture part.

FIG. 1*a* shows a perspective view of an item of furniture 1, in which a movable furniture part 3 is pivotally mounted about a horizontally extending pivoting axis relative to a furniture carcass 2 by an actuating drive 4. By the actuating drive 4, the movable furniture part 3 can be moved, starting from a vertical closed position, into an elevated position relative to the furniture carcass 2 (and in the opposite direction). The furniture drive 4 includes a housing 5 to be fixed to the furniture carcass 2 and, for moving the movable furniture part 3, at least one actuating arm 6 pivotally mounted relative to the housing 5. For applying a force to the actuating arm 6, a spring device 7 is provided, so that the handling of the movable furniture part 3 can be facilitated for a person. The actuating arm 6 can be releasably latched to a fitting portion 22 by a latching device 23, and the fitting portion 22 is to be fixed to the movable furniture part 3.

Figure 1B:
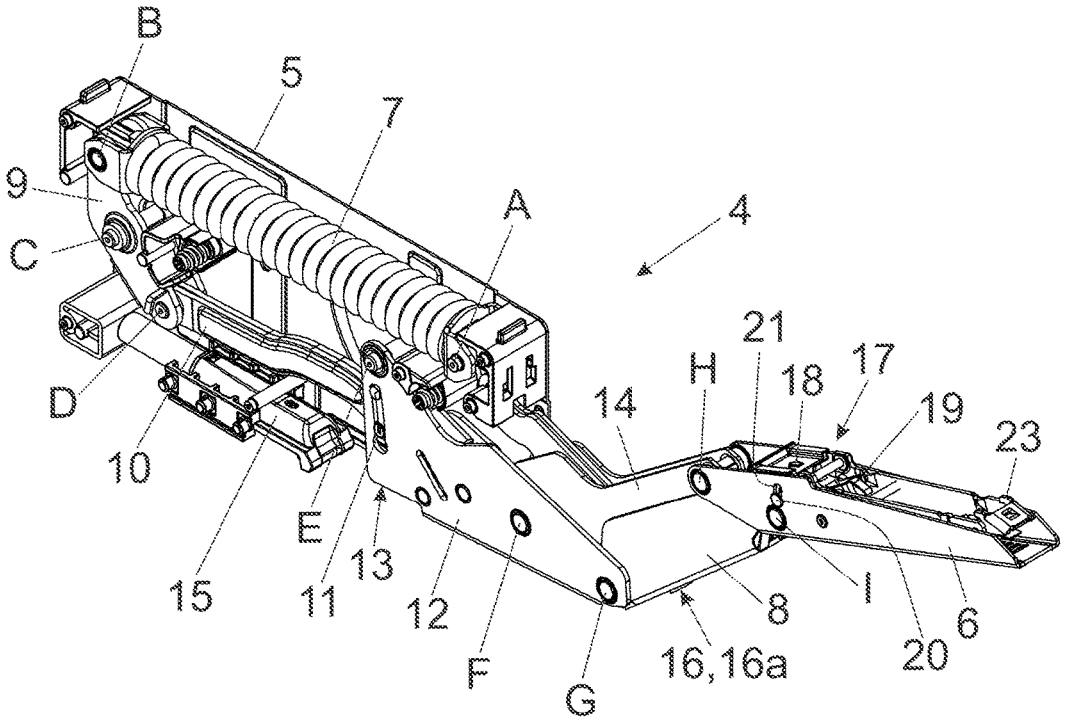

FIG. 1*b* shows the actuating drive 4 according to a possible embodiment. Arranged on the housing 5 is the spring device 7 (for example at least one helical spring configured as a compression spring), the spring device 7 being supported on a stationary hinge axis member A and pressing against the hinge axis member B. The hinge axis member B is arranged on a first lever end of a two-armed deflection lever 9, the deflection lever 9 being pivotally mounted about the hinge axis member C. The second lever end of the deflection lever 9 is connected to a thrust lever 10 by the hinge axis member D, and the thrust lever 10 is hingedly connected via a pin 11 to a lever 12 pivotable about the pivoting axis E. By an adjustment device 13, the distance of the pin 11 relative to the hinge axis member E can be adjusted along a guide of the lever 12. As a result, the operative lever arm between the pin 11 and the hinge axis member E can be varied, so that a torque of the spring device 7 applied to the actuating arm 6 can be adjusted according to the respective weight of the movable furniture part 3. The lever 12 is hingedly connected to levers 8, 14 by the hinge axis members F, G, and the levers 8, 14 are pivotally connected to the actuating arm 6 by the hinge axis members H, I. The actuating drive 4 further includes a damping device 15 in the form of a hydraulic fluid damper which, in the shown embodiment, is configured as a piston-cylinder-unit. Upon a closing movement of the actuating arm 6, the lever 12 pivotable about the hinge axis member E abuts against a ram of the piston-cylinder-unit. For performing a damping hub, a relative movement between the cylinder and the piston of the damping device 15 is brought about. As a result, the movement of the lever 12 (and therewith the movement of the movable furniture part 3) is decelerated at the end of the closing movement until reaching the fully closed position.

The actuating drive 4 includes a limiting device 16 for limiting an opening angle of a relative pivoting movement between the actuating arm 6 and the housing 5, so that the maximum pivoting path of the actuating arm 6 (and therewith the pivoting path of the movable furniture part 3) can be limited. The limiting device 16 includes an actuating element 16*a* movably-mounted on the lever 8, and the maximum opening angle of the actuating arm 6 can be adjustably limited by a manual or by a tool-assisted actuation of the actuating element 16*a*. For example, the limiting device 16 is particularly beneficial when the movable furniture part 3, in the mounted position, is located right below a room ceiling and a collision of the movable furniture part 3 with that room ceiling shall be prevented upon opening. In the shown embodiment, the levers 8, 14, together with the hinge axis members F, G, H, I, form a four-bar linkage, and the distance between the levers 8, 14 can be limited by the limiting device 16.

The actuating drive 4 further includes a locking device 17 for locking a pivoting position of the actuating arm 6. The locking device 17 is particularly advantageous when the movable furniture part 3 is not yet connected to the actuating arm 6, so that an uncontrolled kicking-out movement of the flap-less actuating arm 6 towards the opening direction, due to the torque of the spring device 7 applied to the actuating arm 6, can be prevented. The locking device 17 includes a switch element 18 which can be directly accessed by a user and which is adapted to be actuated manually by the user, and a control portion 19 movably-mounted on the actuating arm 6. The control portion 19 is configured to be acted upon by mounting the movable furniture part 3 to the actuating arm 6 (i.e. by the fitting portion 22 to be fixed to the movable furniture part 3). By applying a force to the switch element 18, and by applying a force to the control portion 19 (namely, by establishing the connection between the actuating arm 6 and the fitting portion 22 by mounting the movable furniture part 3), a locking element 20 is movably-mounted, starting from a position in which the actuating arm 6 is locked, into a position in which the actuating arm 6 is released, along an elongated hole 21 of the actuating arm 6. In the shown embodiment, the locking element 20 is in the form of a cylindrical pin, and both the switch element 18 and the control portion 19 directly engage the locking element 20 so that the locking element can be unlocked by either the switch element 18 or the control portion 19. Arranged on the actuating arm 6 is the latching device 23 having a resilient latching lever by which the actuating arm 6 can be releasably latched to the fitting portion 22 to be fixed to the movable furniture part 3. Provided on the actuating arm 6 is at least one adjustment device 27 having an adjustment wheel, and by rotating the adjustment wheel, a position of the actuating arm 6 relative to the fitting portion 22 can be adjusted.

Figure 2A:
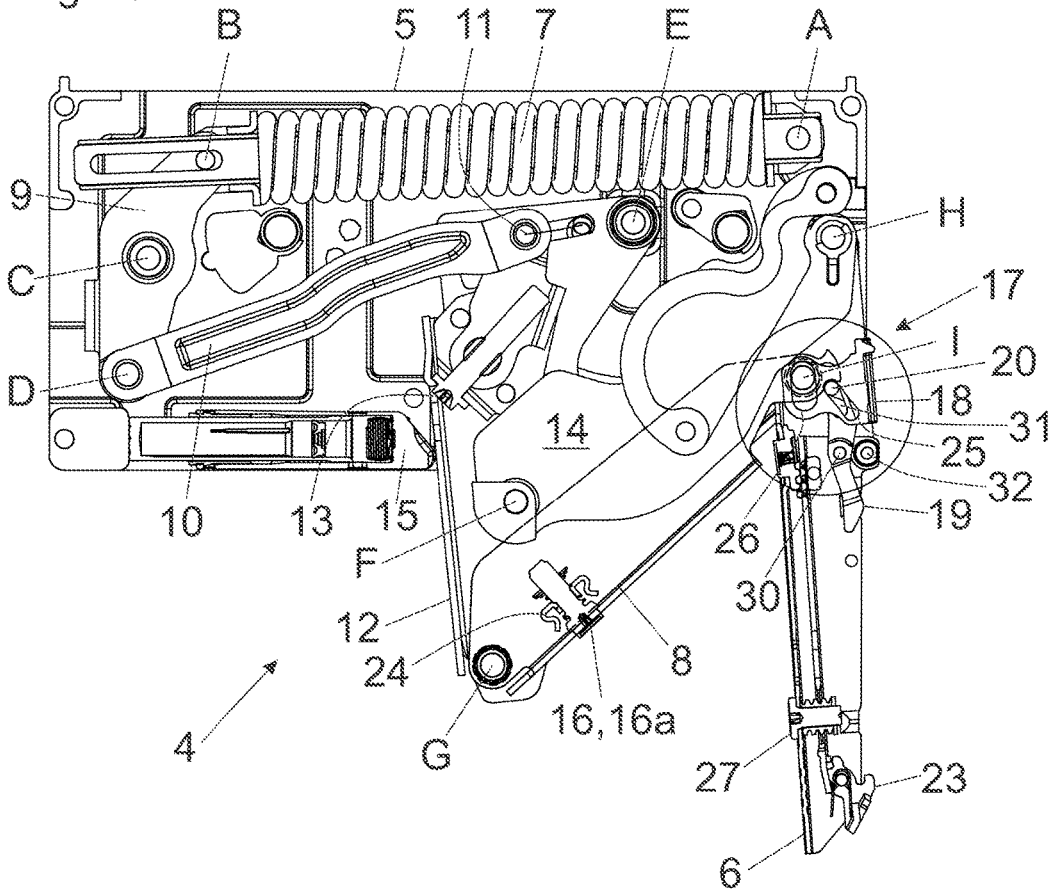
FIG. 2*a*, 2*b* are a cross sectional view of the actuating drive with a locked actuating arm, and an enlarged detail view thereof.

FIG. 2*a* shows a cross sectional view of the actuating drive 4 according to FIG. 1*b*. The limiting device 16 for limiting the opening angle of the actuating arm 6 includes an abutment member 24, and a position of the abutment member 24 can be adjusted, preferably continuously, by an actuation of the actuating element 16*a*. The actuating element 16*a* is arranged on the lever 8, the abutment member 24 cooperates with the lever 14, preferably with a wall thickness of the lever 14, in a position in which the opening angle is limited. In FIG. 2*a*, the actuating arm 6 is locked by the locking device 17, so that an unintentional opening or kicking-out movement of the actuating arm 6 in that pivoting range, in which the spring device 7 pressurizes the actuating arm 6 in the opening direction, is prevented.

Figure 2B:
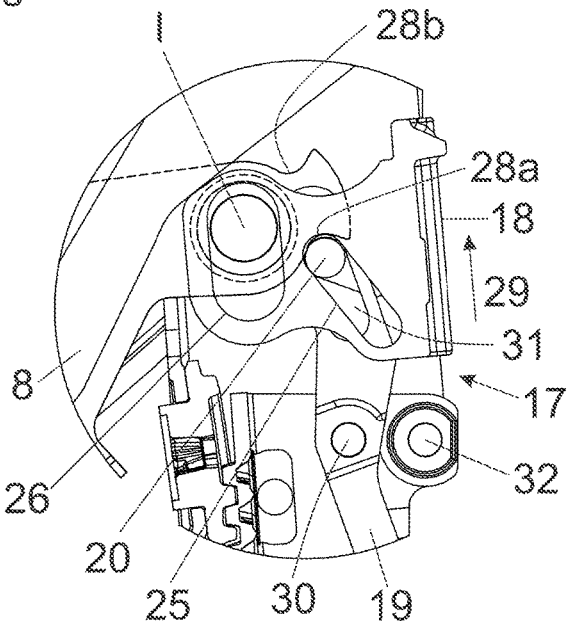

The locking device 17 includes the locking element 20 by which the hinge axis member I, the switch element 18 and the control portion 19 are locked to one another in a position in which the actuating arm 6 is locked. The actuating arm 6 is thereby locked in the closed position, and the locking element 20 is accommodated in a first locking recess 28*a* of the lever 8. For locking the actuating arm 6 in an open position, a second locking recess 28*b* is provided, and the actuating arm 6 in the open position can be accommodated in the second locking recess 28*b*. In the shown figure, the switch element 18 is movably-mounted on the actuating arm 6 so as to be movable in a direction of the arrow 29 (see FIG. 2*b*) and has at least one first guide track 25 for the displaceable arrangement of the locking element 20, and a second guide track 26 for the displaceable arrangement of the hinge axis member I. The locking element 20, by a manual actuation of the switch element 18 or by the actuation of the control portion 19, is movably mounted in or along the first guide track 25, and the hinge axis member I is movably mounted in or along the second guide track 26. The control portion 19 can be configured as a lever pivotally mounted about a pivoting axis 30, and a first lever end of the lever (in the region of reference numeral 19 in FIG. 2*b*) can be acted upon by the fitting portion 22 when mounting the movable furniture part 3. A second lever end of the control portion 19 has a guide 31 for the displaceable arrangement of the locking element 20. When mounting the movable furniture part 3, the fitting portion 22 pre-mounted to the movable furniture part 3 is firstly engaged into a bearing 32 of the actuating arm 6. By a subsequent pivoting movement, the fitting portion 22 (and therewith the movable furniture part 3) can be latched with the latching lever of the latching device 23. FIG. 2*b* shows the region encircled in FIG. 2*a* in an enlarged view.

Figure 3A:
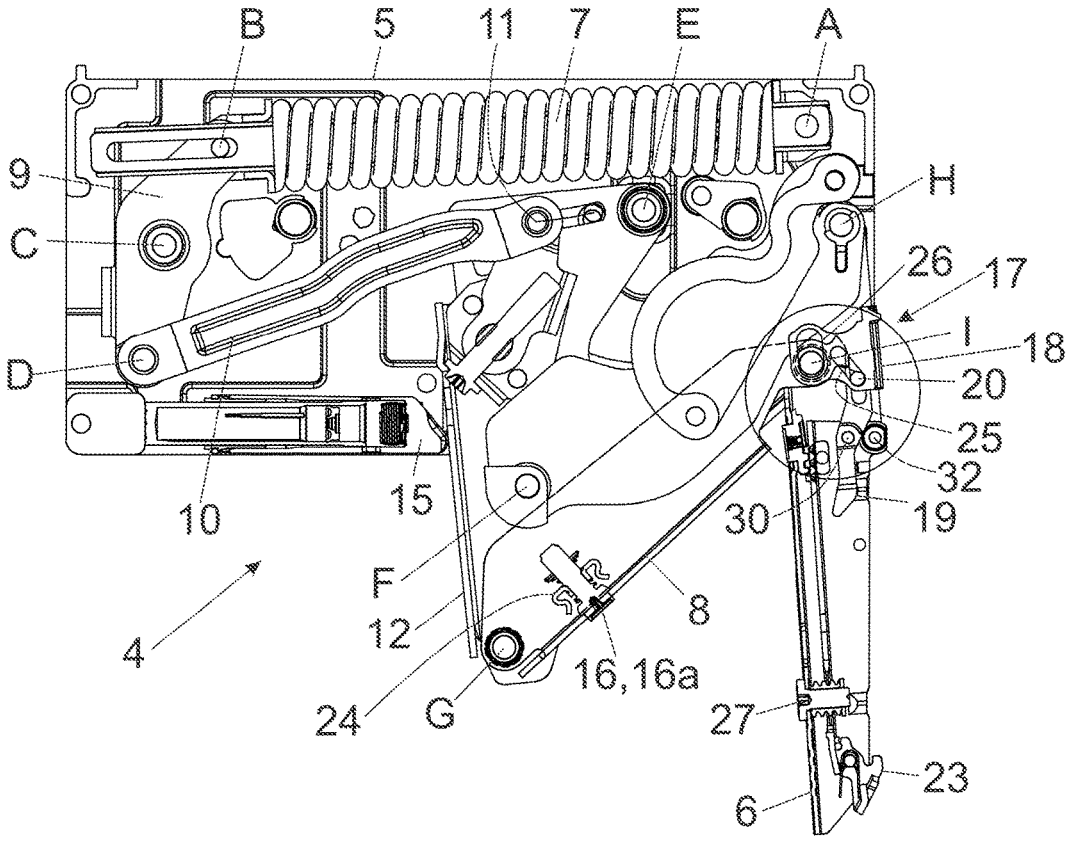
FIG. 3*a*, 3*b* are a cross sectional view of the actuating drive with an unlocked actuating arm, and an enlarged detail view thereof.
Figure 3B:
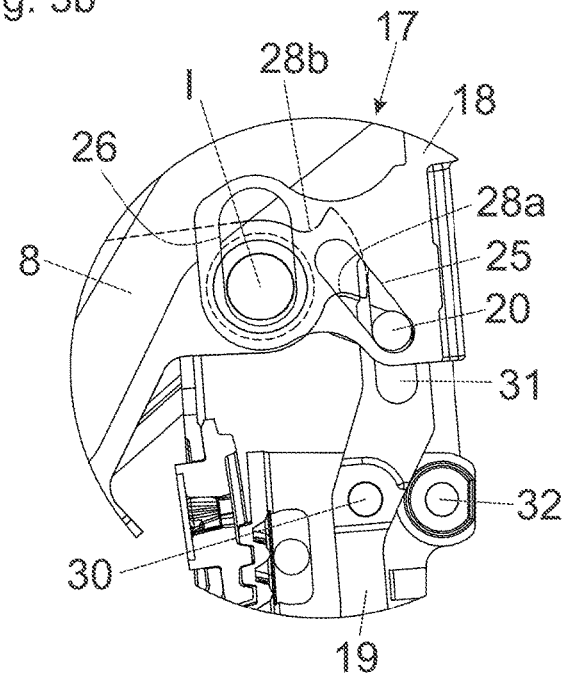

FIG. 3*a* shows the actuating drive 4 according to FIGS. 2*a*, 2*b* with the actuating arm 6 in an unlocked position. When the switch element 18 is moved, by a manual application of force in a direction of the depicted arrow 29 starting from the position shown in FIG. 2*b*, the locking element 20 is moved out from the locking recess 28*a* and is displaced along the first guide track 25 of the switch element 18. The hinge axis member I is moved along the second guide track 26 of the switch element 18, the control portion 19 is pivoted about the pivoting axis 30 and the locking element 20 is displaced along the guide 31 of the control portion 19. The same applies when the movable furniture part 3 is mounted to the actuating arm 6. In this case, the fitting portion 22 to be fixed to the movable furniture part 3 would act upon the lever arm of the control portion (in the region of reference numeral 19) in a clockwise direction, so that the unlocking of the locking element 20 from the locking recess 28*a* and the motion sequences as described above follow in an identical manner. The switch element 18, in this case, would then move by itself in a direction of the depicted arrow 29 (see FIG. 2*b*) by mounting the fitting portion 22 to the actuating arm 6. For the operator (user), it is thus possible to unlock the actuating arm 6 by a manual actuation of the switch element 18 in a direction of the arrow 29, or alternatively, by mounting the fitting portion 22 to the actuating arm 6. After unlocking has been effected, the actuating arm 6 can further be moved towards the open position by applying a force to the switch element 18 in a direction of the arrow 29.

Figure 4A:
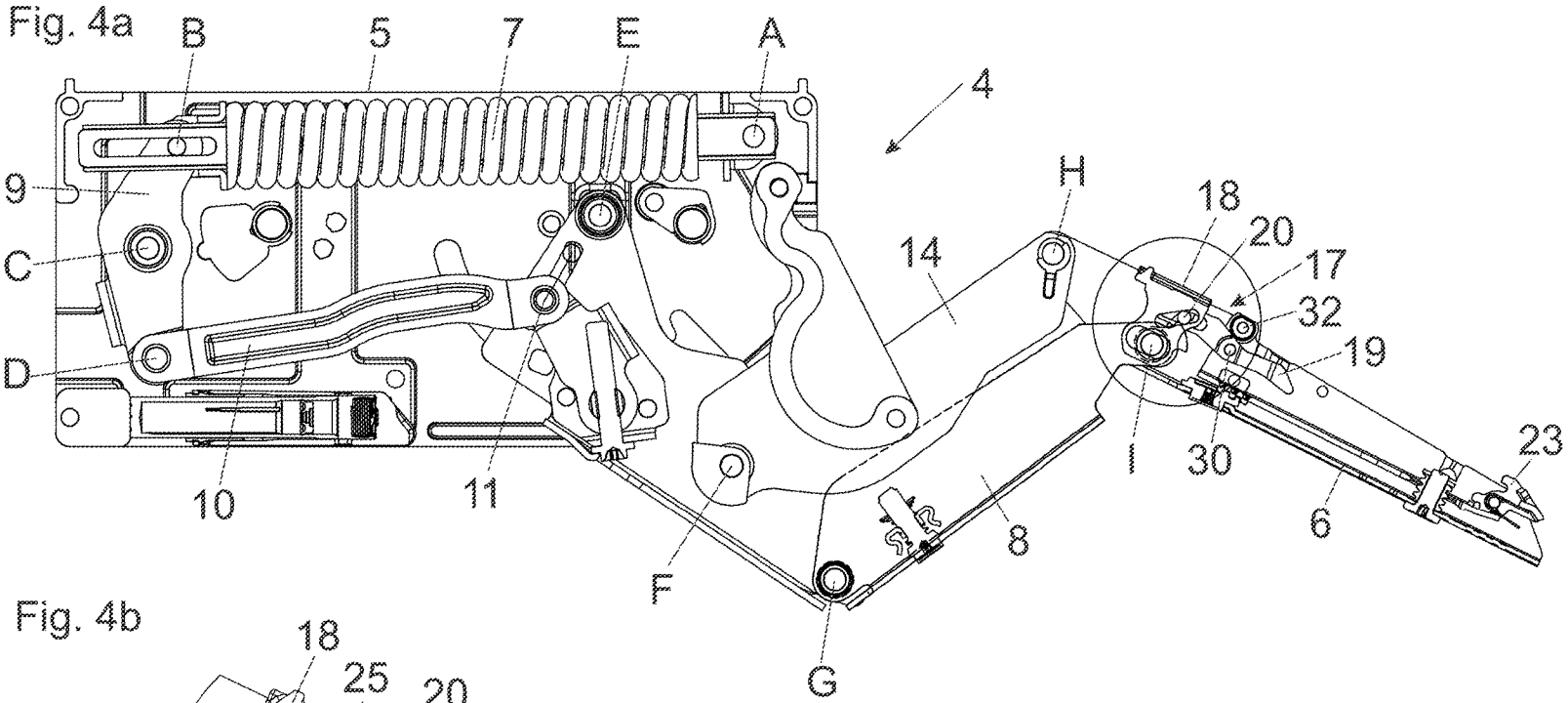
FIG. 4*a*, 4*b* are a cross sectional view of the actuating drive in which the actuating arm is in an open position, and an enlarged detail view thereof, FIG. 5*a*, 5*a* are a cross sectional view of the actuating drive in which the actuating arm, in the open position, is connected to the movable furniture part, and an enlarged detail view thereof.
Figure 4B:
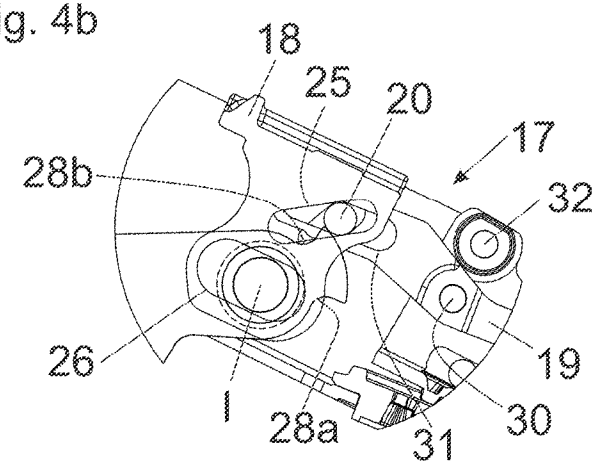

FIG. 4*a* shows a cross sectional view of the actuating drive 4 with the actuating arm 6 in an open position. FIG. 4*b* shows the encircled region of FIG. 4*a* in an enlarged view. The actuating arm 6, while maintaining the application of pressure to the switch element 18, can be moved in a direction of the arrow 29 towards the open position in a controlled manner. When the application of pressure to the switch element 18 is removed, the locking element 20 can be automatically locked to the second locking recess 28*b* of the lever 8 by the force of the spring element 33 (see FIG. 8*b*), so that the actuating arm 6 is locked in the open position.

Figure 5A:
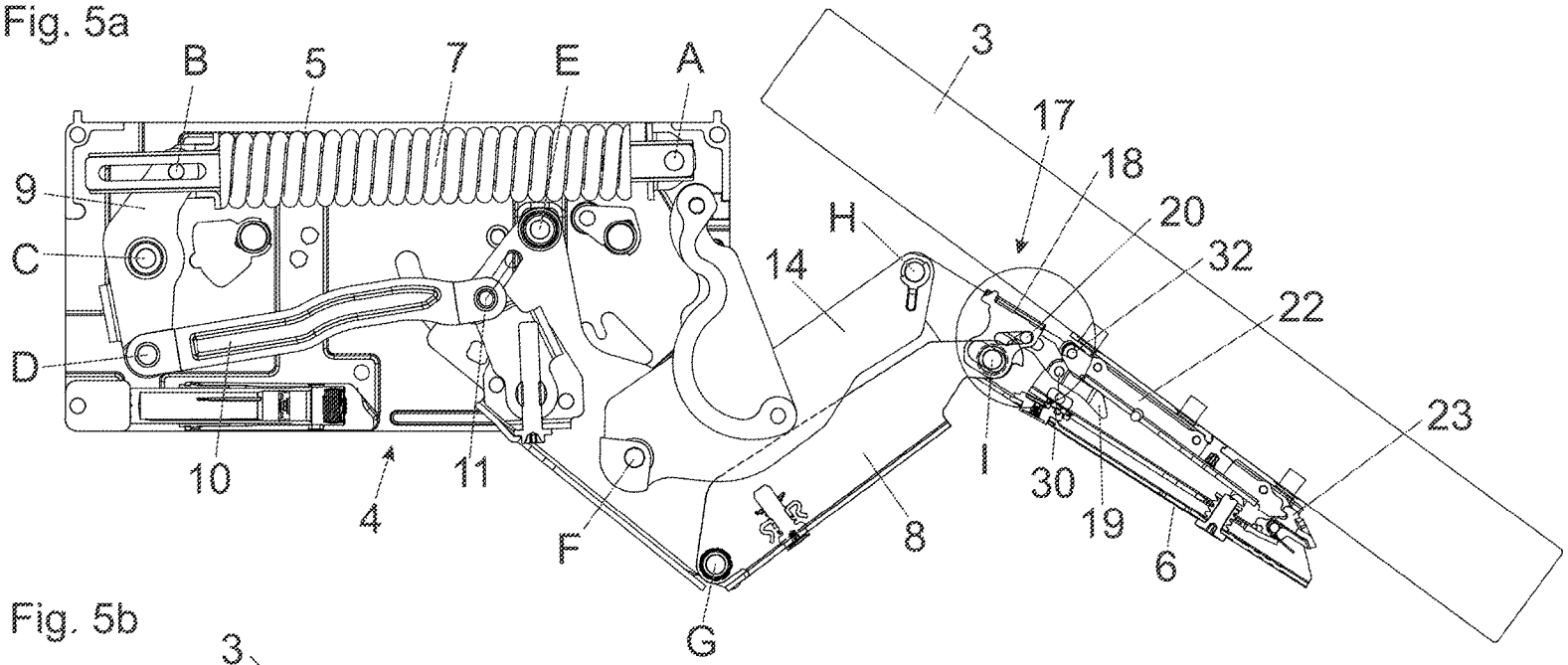
Figure 5B:
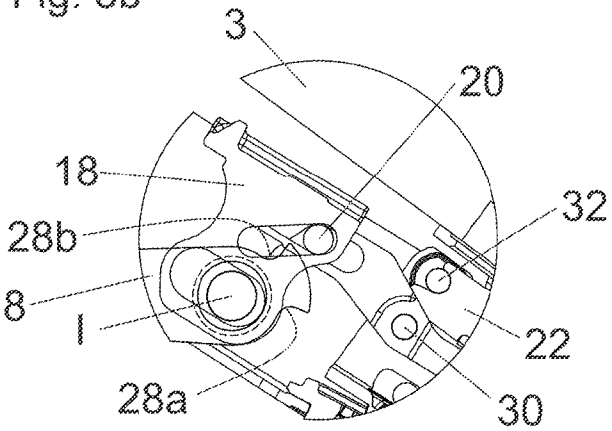

FIG. 5*a* shows a cross sectional view of the furniture drive 4 with the furniture part 3 mounted to the actuating arm 6. In the mounting procedure, the fitting portion 22 fixed to the furniture part 3 is firstly engaged with an end region into the bearing 32 of the actuating arm 6 and pivoted about that bearing 32 to such an extent until the second end region of the fitting portion 22 can be releasably latched to the resilient locking lever of the latching device 23. Due to this mounting, the control portion 19 is pushed by the fitting portion 22 in a clockwise direction about the pivoting axis 30, so that the locking element 20 is unlocked from the second locking recess 28*b* of the lever 8 and the actuating arm 6 is released for performing a pivoting movement. FIG. 5*b* shows the encircled region of FIG. 5*a* in an enlarged view.

Figure 6B:
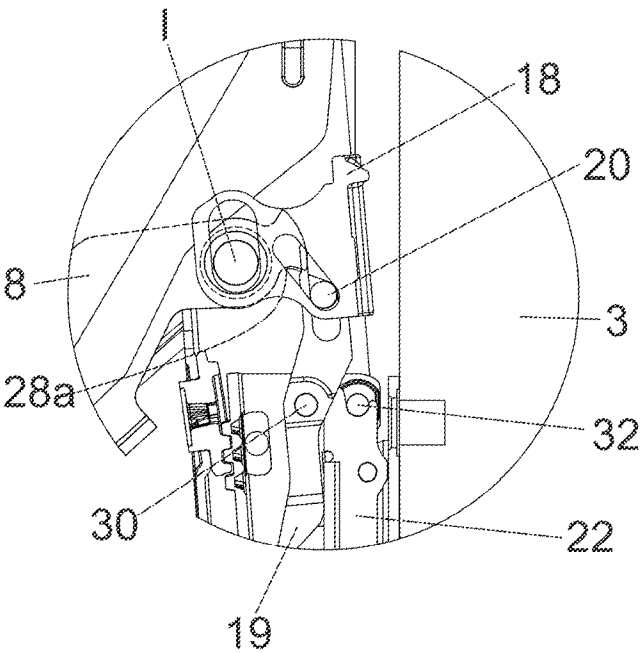
FIG. 6*a*, 6*b* are a cross sectional view of the actuating drive in which the actuating arm, in the closed position, is connected to the movable furniture part, and an enlarged detail view thereof.
Figure 6A:
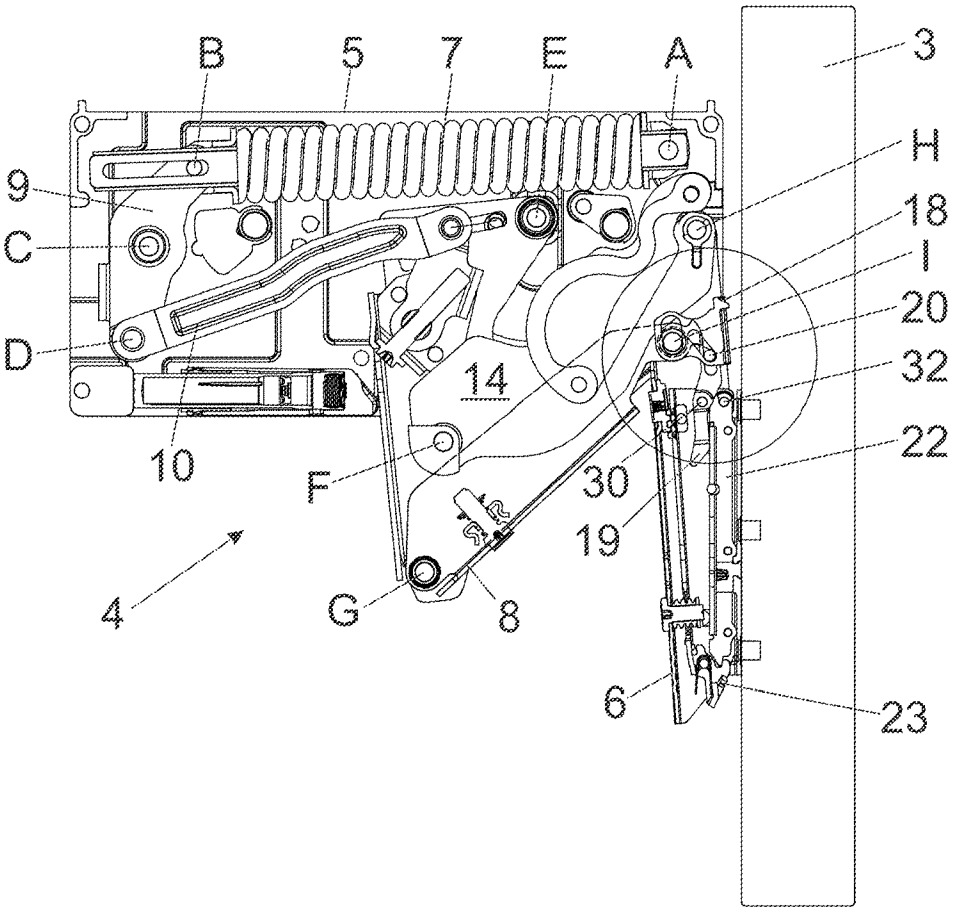

FIG. 6*a* shows a cross sectional view of the actuating drive 4, in which the actuating arm 6 located in the closed position is connected to the movable furniture part 3. Starting from the position shown in FIG. 2*a*, in which the actuating arm 6 is locked by the locking element 20 in the closed position, the fitting portion 22 fixed to the movable furniture part 3 is engaged into the bearing 32 of the actuating arm 6 and is pivoted to such an extent until the second end region of the fitting portion 22 can be releasably latched to the locking lever of the latching device 23. By this mounting, the control portion 19 is pushed by the fitting portion 22 about the pivoting axis 30 in a clockwise direction, so that the locking element 20 is unlocked from the first locking recess 28*a* of the lever 8 and the actuating arm 6 is released for performing a pivoting movement. FIG. 6*b* shows the encircled region of FIG. 6*a* in an enlarged view.

Figure 7A:
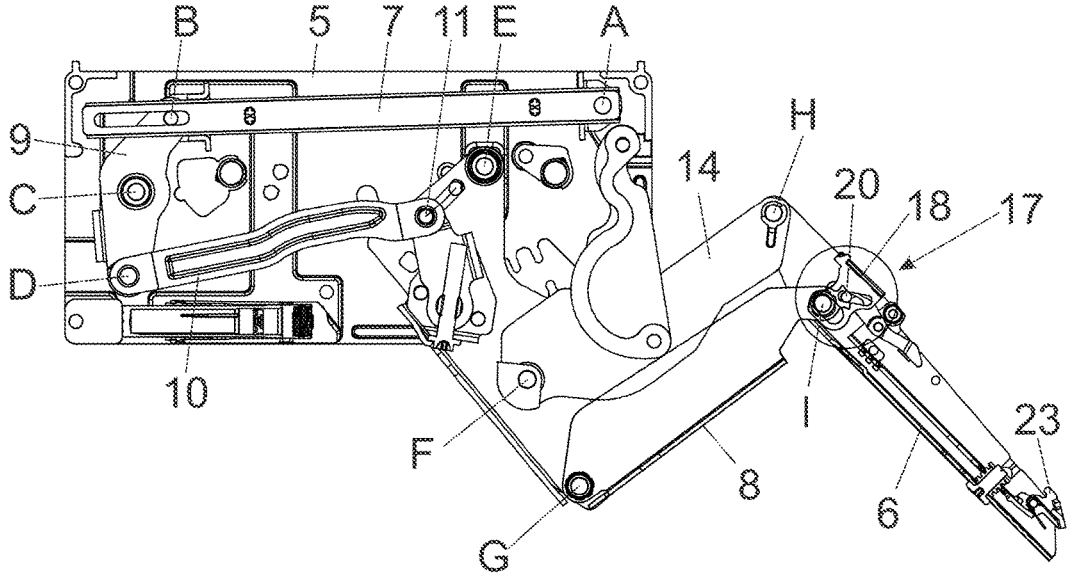
FIG. 7*a*, 7*b* are a cross sectional view of the actuating drive in which the actuating arm, in a half-open position, can be connected to the movable furniture part, and an enlarged detail view thereof.
Figure 7B:
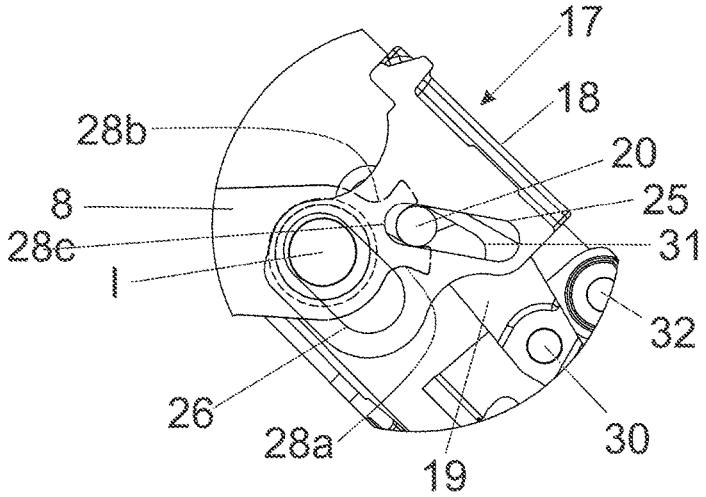

FIG. 7*a* shows a cross sectional view of the actuating drive 4, in which the actuating arm 6, in a half-open position, can be connected to the movable furniture part 3. For this purpose, the locking device 17 includes a third locking recess 28*c* in which the locking element 20 can be accommodated. Each of the first, second and third locking recesses 28*a*, 28*b*, 28*c* can be formed on a peripheral rim of the lever 8. The locked actuating arm 6 is approximately in a 45° open position and can be unlocked either by applying a force to the switch element 18 or by mounting the movable furniture part 3 to the actuating arm 6. Visible are the linear guide tracks 25, 26 of the switch element 18, and the main longitudinal axes of the guide tracks 25, 26 extend transversely to one another. Also visible is the guide 31 of the control portion 19 along which the locking element 20 can be displaced.

Figure 8A:
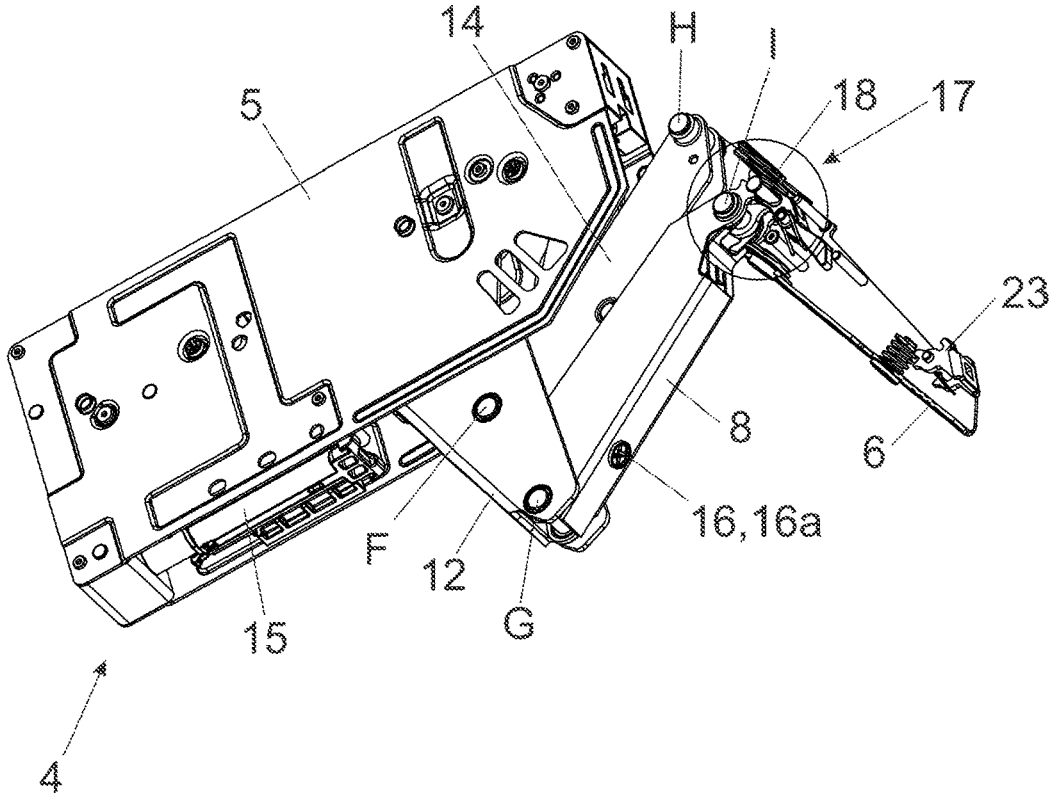
FIG. 8*a*, 8*b* show the actuating drive in a perspective and partially broken-away view, and an enlarged detail view thereof.
Figure 8B:
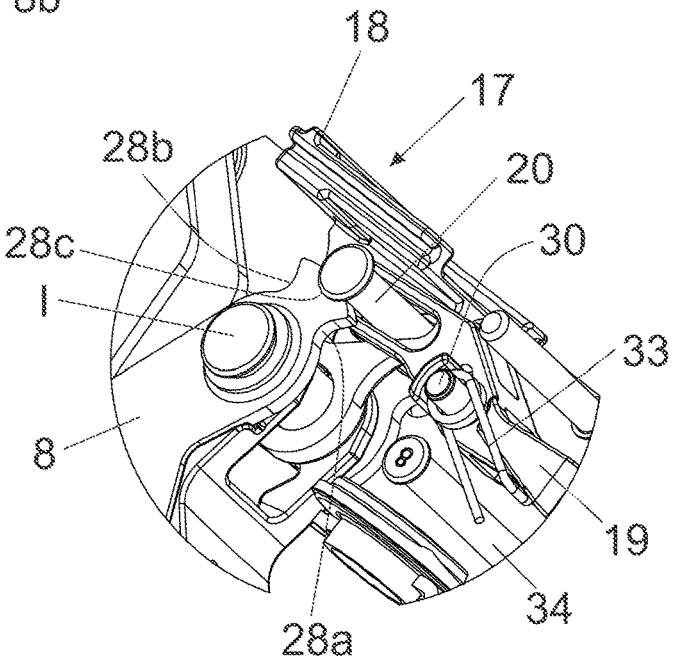

FIG. 8*a* shows the actuating drive 4 in a perspective and partially broken-away view. The actuating arm 6 is pivotally mounted relative to the housing 5 by the levers 8, 12, 14, and the closing movement of the actuating arm 6 can be dampened by a damping device 15. Visible is the actuating element 16*a* of the limiting device 16, the actuating element 16*a* being arranged on the lever 8 and is provided for limiting the maximum opening angle of the actuating arm 6. FIG. 8*b* shows the encircled region of FIG. 8*a* in an enlarged view, in which the locking element 20 can be alternatively unlocked from the three different locking recesses 28*a*, 28*b*, 28*c* by the switch element 18 and by the control portion 19. The switch element 18 and/or the control portion 19 are pre-stressed by a spring element 33 in a direction towards the locking position. The spring element 33 serves to again move the locking element 20 into the locking position when the switch element 18 is not actuated or when the fitting portion 22 is separated from the actuating arm 6, so that the actuating arm 6 in its pivoting position is automatically locked by the force of the spring element 33. In the shown embodiment, the spring element 33 is configured as a leg spring arranged on the pivoting axis 30. A first end of the leg spring presses against a counterstop 34 of the actuating arm 6 and a second end of the leg spring presses against the control portion 19, so that the locking element 20 is permanently acted upon by a force in a direction towards the locking recesses 28*a*, 28*b*, 28*c*.

The invention claimed is:

1. An actuating drive for moving a furniture part movably supported relative to a furniture carcass, the actuating drive comprising:

a pivotally mounted actuating arm for moving the movable furniture part, a spring device for applying a force to the actuating arm, and a locking device for releasably locking the actuating arm, wherein the locking device includes a movably-mounted locking element cooperating with a locking recess in a position in which the actuating arm is locked, wherein the locking element is configured to be unlocked from the locking recess by a directly-accessible and manually-operated switch element, and also by a control portion arranged on the actuating arm, wherein the control portion is configured to be acted upon by mounting the movable furniture part to the actuating arm.

2. The actuating drive according to claim 1, wherein the actuating arm is configured to be locked in a closed position by a cooperation of the locking element with the locking recess.

3. The actuating drive according to claim 1, wherein the locking recess is a first locking recess, the actuating drive further comprising a second locking recess, wherein the actuating arm is configured to be locked in an open position by a cooperation of the locking element with the second locking recess.

4. The actuating drive according to claim 3, further comprising a third locking recess, wherein the actuating arm is configured to be locked in an intermediate position by a cooperation of the locking element with the third locking recess, the intermediate position lying operatively between the open position and the closed position.

5. The actuating drive according to claim 4, wherein the intermediate position is a half-open position of the actuating arm.

6. The actuating drive according to claim 1, wherein the switch element is configured to be moved between a first switching position and a second switching position, wherein in the first switching position, the locking element is engaged in the locking recess, and in the second switching position, the locking element is disengaged from the locking recess.

7. The actuating drive according to claim 1, wherein the switch element is movably-mounted on the actuating arm.

8. The actuating drive according to claim 1, wherein the switch element has a first guide track, wherein the locking element is movable in or along the first guide track by a manual actuation of the switch element or by being acted upon by the control portion.

9. The actuating drive according to claim 8, wherein the switch element has a second guide track, wherein a hinge axis member of the actuating arm is movable in or along the second guide track by a manual actuation of the switch element or by being acted upon by the control portion.

10. The actuating drive according to claim 1, wherein the control portion is configured as a lever having a first lever end and a second lever end, the lever being pivotally mounted about a pivoting axis, the first lever end of the lever to be acted upon by a fitting portion to be fixed to the movable furniture part when the movable furniture part is mounted to the actuating arm, and the second lever end of the lever has a guide in or along which the locking element is displaceably arranged.

11. The actuating drive according to claim 10, wherein the actuating arm is configured to be releasably latched to the fitting portion to be fixed to the movable furniture part.

12. The actuating drive according to claim 1, wherein the actuating arm is pivotally connected to a lever by a hinge axis member, wherein the locking device is operative between the actuating arm and the lever.

13. The actuating drive according to claim 12, wherein the locking recess is formed or arranged on the lever.

14. The actuating drive according to claim 1, wherein the locking element is configured as a cylindrical pin.

15. The actuating drive according to claim 1, further comprising a spring element, wherein at least one of a group consisting of the switch element and the control portion is or are pre-stressed by the spring element in a direction towards the locking position.

16. The actuating drive according to claim 1, wherein both the switch element and the control portion directly engage the locking element.

* * * * *